United States Patent [19]

Shetka

[11] Patent Number: 5,064,504

[45] Date of Patent: Nov. 12, 1991

[54] PULP MOLDING PRESS

[76] Inventor: Stanley J. Shetka, 10247 40th St. West, Box 44D, Webster, Minn. 55088

[21] Appl. No.: 635,885

[22] Filed: Jan. 2, 1991

Related U.S. Application Data

[62] Division of Ser. No. 324,263, Mar. 14, 1989, Pat. No. 4,994,148.

[51] Int. Cl.[5] ..... D21J 3/00

[52] U.S. Cl. ..... 162/396; 162/408; 425/84

[58] Field of Search ..... 162/382, 396, 408; 425/84, 86

[56] References Cited

U.S. PATENT DOCUMENTS

| | | | |
|---|---|---|---|
| 906,043 | 12/1908 | Malcolm | 162/227 |
| 1,951,940 | 3/1934 | Manson | 162/227 |
| 2,026,765 | 1/1936 | Woodford | 162/227 |
| 2,105,593 | 1/1938 | Hatton | 162/396 |
| 3,070,485 | 12/1962 | Strickman | 264/86 |
| 3,667,880 | 6/1972 | Malet et al. | 425/84 |
| 3,895,998 | 7/1975 | Haywood et al. | 162/231 |
| 4,497,662 | 2/1985 | Chisholm et al. | 264/86 |

FOREIGN PATENT DOCUMENTS

| | | | |
|---|---|---|---|
| 2718622 | 11/1978 | Fed. Rep. of Germany | 425/64 |

*Primary Examiner*—Karen M. Hastings

*Attorney, Agent, or Firm*—Willian Brinks Olds Hofer Gilson & Lione

[57] ABSTRACT

A method and pulp press for recycling wood fiber products, and particularly newspaper-type pulp, into a new and useful molded product is disclosed. A quantity of paper to be recycled is mixed with sufficient water to form a viscous pulp or slurry by beating the pulp to a desired consistency for a given texture of the product to be made. The pulp press employed has a molding chamber with interior sidewalls comprised of a rigid screen through which water can pass and a rigid plate outboard from the screen. The rigid plate has channels formed therein facing the screen through which channels water can flow. One of the sidewalls is movable into the molding chamber to serve as a piston. Some means to drive the movable sidewall, such as an hydraulic jack, completes the press. The beaten pulp is poured into the molding chamber. The chamber is then closed, and the press operated by moving the movable sidewall into the chamber to compress the beaten pulp to a desired pressure and pulp density. Water and air are forced out of the slurry through the screens and into the rigid plate channels to drain. The compressed pulp is then dried to thereby yield a new pulp paper product. In a preferred form, the foregoing method further includes the use of a template for making an image on the pulp product during compression.

1 Claim, 3 Drawing Sheets

PULP MOLDING PRESS

This is a division of application Ser. No. 07/324,263, filed Mar. 14, 1989 now U.S. Pat. No. 4,994,148.

FIELD OF THE INVENTION

This invention generally relates to the production of molded products using a wood-fiber slurry mixture as the medium, and more particularly to a method for manufacturing such molded products from recycled newsprint and other reusable paper products.

BACKGROUND OF THE INVENTION

It is of course not news that man has entered a period where disposing of the detritus of society has become an increasing concern. Burgeoning landfills have reached acute proportions in many of the nation's cities.

Turning to biodegradable products, where possible, is one avenue of attack on the problem of waste disposal. Yet the waste, even if ultimately biodegradable, must still be deposited somewhere to degrade. A better course is to recycle one expended product into another, and perhaps different, useful product.

Paper products are ubiquitous. Newsprint and other paper pulp products are particularly plentiful, yet invariably end up as waste to be burned or buried.

The present invention has its roots in taking such paper pulp which would otherwise be garbage, and recycling them into other products which themselves may be recycled.

SUMMARY OF THE INVENTION

It is a principal objective of the present invention to provide a method for recycling wood-fiber products, and particularly newspaper-type pulp, into a new and useful molded product. To this end, the invention finds form in a method for making a product from recycled paper comprising the first step of providing a quantity of paper, preferably used paper, to be recycled. The paper is mixed with sufficient water to form a viscous pulp or slurry by beating the pulp to a desired consistency for a given texture of the product to be made. The finer the cellulose fibers are comminuted, the finer the "grain" of the end product.

A pulp press is employed which has a molding chamber with interior sidewalls comprised of a rigid screen through which water can pass and a rigid plate outboard from the screen. The rigid plate has channels formed therein facing the screen through which channels water can flow. One of the sidewalls is movable into the molding chamber to serve as a piston. Some means to drive the movable sidewall, such as an hydraulic jack, complete the press.

The beaten pulp is poured into the molding chamber. The chamber is then closed, and the press operated by moving the movable sidewall into the chamber to compress the beaten pulp to a desired pressure and pulp density. Water and air are forced out of the slurry through the screens and into the rigid plate channels to drain. The compressed pulp is then dried to thereby yield a new pulp paper product.

In a preferred form, the foregoing method further includes the step of providing a template for making an image on the finished pulp product. The template is placed in the chamber in contact with the pulp prior to operating the press.

While the most preferred method of the invention employs a water and pulp mixture for the slurry without the use of any binder, thereby rendering the new product also recyclable, the method nonetheless contemplates use of a binder in some applications. A binder such as plaster, cement or the like can be added to the mixture, in which event the compressed pulp is maintained under the desired pressure until the plaster, cement or the like has sufficiently set.

A wide variety of products can be made by the method of this invention. For example, an article of stock material useful in fabricating other products can be made as a block. Artwork, jewelry, toys and furniture are other products that can be made according to the foregoing method.

The pulp press used in the foregoing method is also considered to be novel. As noted above, the sidewalls of the press define a molding chamber for receiving the aqueous pulp to be compressed. Substantially all, and most preferably all, of the sidewalls are comprised of a rigid screen through which water can pass. The screen is the innermost portion of the sidewall, with a rigid plate located outboard from the screen. The rigid plate has channels formed therein facing the screen through which channels liquid can flow.

As already noted, one of the sidewalls is movable relative to the others to serve as a piston. All of the sidewalls are otherwise fixed together. The movable sidewall compresses the pulp to a desired pressure and pulp density under the action of an hydraulic jack, for example.

The features and advantages of the invention will be further understood upon consideration of the following detailed description of an embodiment of the invention taken in conjunction with the accompanying drawings, in which:

DETAILED DESCRIPTION OF AN EMBODIMENT OF THE INVENTION

Figure 1:
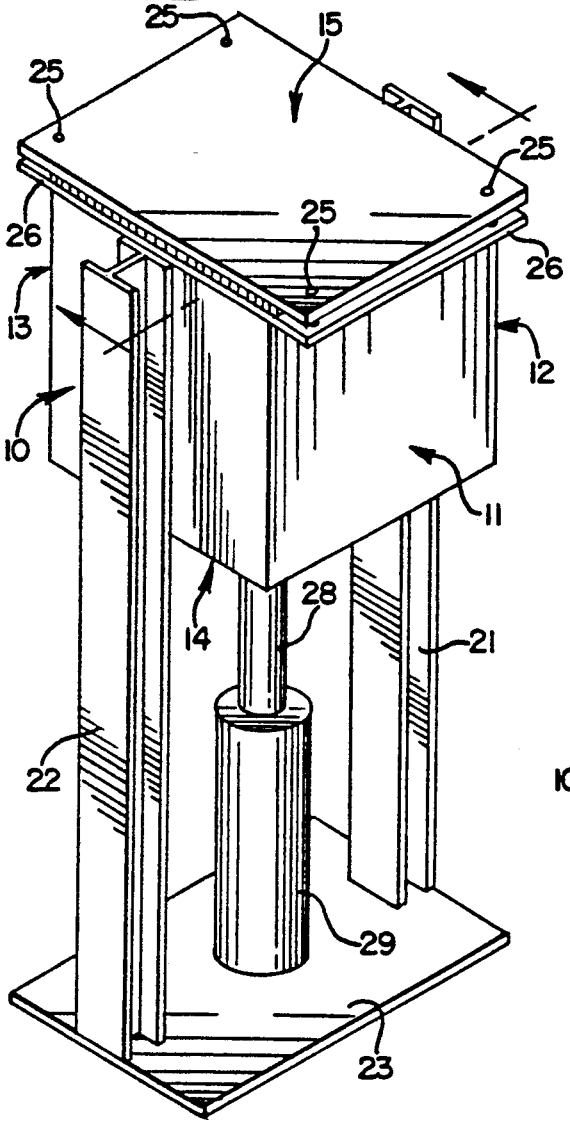
FIG. 1 is a perspective view of a press made in accordance with the teachings of this invention.
Figure 2:
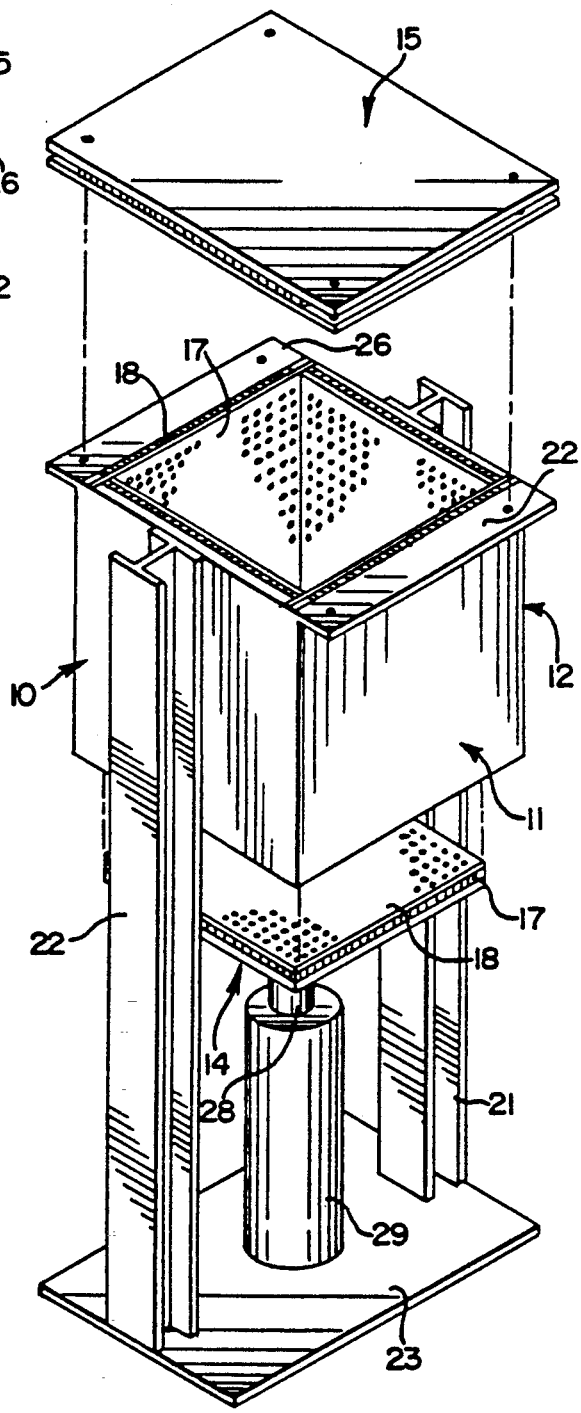
FIG. 2 is a view similar to that of FIG. 1 with the top plate removed and the lower, and movable, plate retracted from the molding chamber.

The invention has found particular application in making a variety of products from recycled paper pulp, such as newsprint. In its most preferred form, 100% waste newspaper is used in keeping with the objective of recycling society's effluence, which is at the root of the invention. Any paper or cellulose material, or other fibrous material comprised of cotton, wool, linen and the like may be used, however.

Any used pulp paper product, such as newspaper, cardboard boxes, magazines, office paper, etc., is soaked in water to soften. Soaking the paper makes subsequent beating of the wet paper easier. The paper can also be initially cut up to advance the soaking process.

The soaked pulp paper is then beaten into a slurry. Sufficient water is added to the paper during beating to create an aqueous mixture that is fairly viscous, but generally flowable for later pouring. A 50—50 combination of water and paper has been found advantageous. The ratio will generally vary with the type of paper being used, as well as the particular end product that may be desired. There should be sufficient water, however, so that the paper is "suspended" in the slurry for desired saturation, comminution (overall fiber size) and pourability.

The beater used should be a mixer that does not overly chop the paper, since chopping is considered to destroy the long paper fibers that are desired for strength in the final product. The length of beating is determined by the type of paper used and the desired finished texture of a the product to be produced. The longer the slurry is beaten, the finer the "grain" of the end product, in general. A finer pulp is desirable for jewelry, for example, while a coarser pulp is desirable for large blocks of stock material useful in fabrication of articles of furniture.

Various additives and binders can be added to the aqueous mixture during the beating process, although the use of binders is not preferred, since this reduces the ability to recycle the products made according to the present method. Neutralizing chemicals can be used to balance the pH of the mixture to better preserve the end product. Fire-proofing chemicals, sizing agents, dyes, pigments, insect repellants etc. can likewise be added to enhance the final product.

Binders and fillers such as plaster, concrete and latex, for example, can also modify the gross physical properties of the end product. Plaster and cement obviously will add strength to the product, while latex will lend flexibility. Products made from mixtures including plater or cement binders include building blocks and tiles, to name but two. It has been found that a mixture including about 20% to about 50% of plaster yields a uniquely textured stone-hard material.

The aqueous slurry, with or without additives and binders, which has been sufficiently beaten is then poured into the molding chamber of a press. The press used in the method of this invention is shown in FIGS. 1,2 and 4–6.

The press has a plurality of sidewalls 10–15 forming a box. Each sidewall (FIG. 6) is comprised of a heavy rigid metal screen 17 made from stainless steel. The screen openings are about 0.015 or 1/16 of an 1" mm in diameter, and are formed by punching or drilling. The size of the openings is sufficient to allow water to pass therethrough without the concomitant passage of much pulp. The screen 17 is the innermost part of the sidewall, being adjacent the slurry admitted to the molding chamber formed by the sidewalls 10–15.

Outboard from each screen 17 is a heavy rigid impermeable plate 18. The impermeable plate 18 has a plurality of parallel grooves 20 in its inboard face forming channels. Screen 17 and plate 18 are in facial engagement, and water passing through the screen 17 flows into the grooves or channels 20, where it can then drain from the press. Water and air is therefore pressed out of the slurry on all sides during compression, since each sidewall has the foregoing screen and channelled plate combination.

The lateral sidewalls 10–13 are joined together in some suitable fashion, as by bolting, welding or the like. Here, they are welded together. Steel I-beams 21 and 22 are welded to the exterior of sidewalls 10 and 12 to support the molding chamber. The I-beams 21, 22 are welded at their bottom to a steel plate 23 which forms the base for the press.

Top sidewall 15 forms the cover for the molding chamber. After the slurry is admitted to the mixing chamber, top sidewall 15 is fixed in place using heavy bolts 25 that extend through the sidewall 15 and are retained in bores provided in laterally extending flanges 26 extending outwardly from sidewalls 11 and 13 adjacent their top edges. A fairly close fit between all of the sidewalls is desired.

Bottom sidewall 14 is movable relative to the other sidewalls (with sidewall 15 fixed in place). Sidewall 14 forms the piston head used to compress the slurry in the molding chamber. It is mounted to the head of a piston rod 28 of an hydraulic jack 29. Jack 29 is mounted to the base plate 23.

Figure 5:
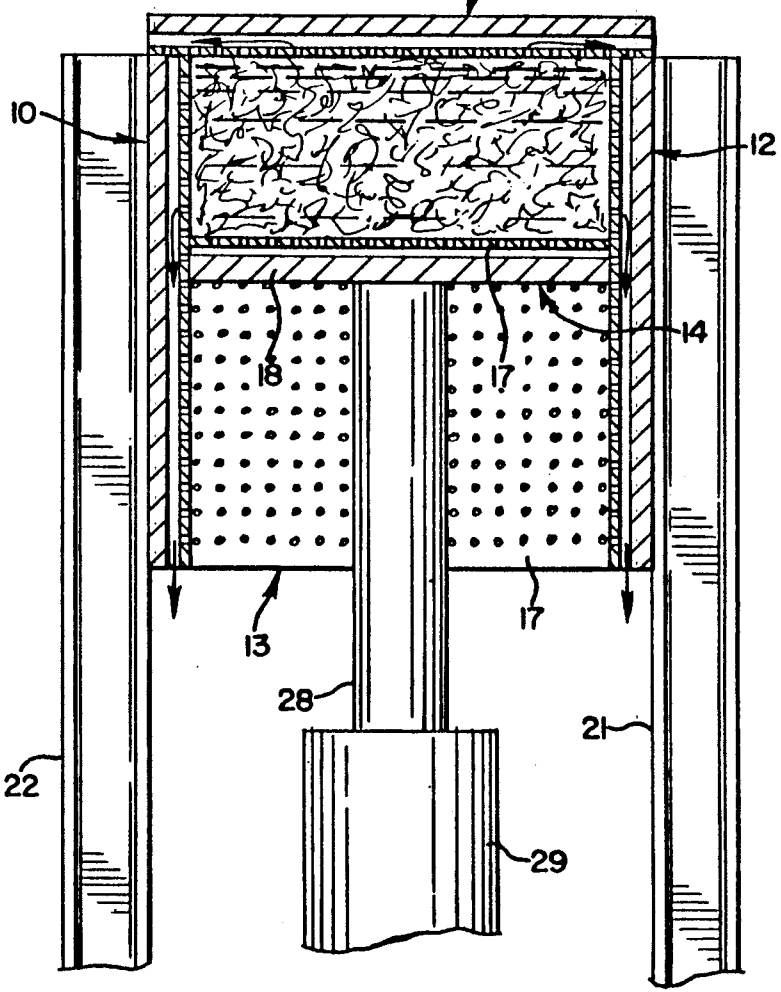
FIGS. 4 and 5 are enlarged sectional views taken along the line shown in FIG. 1 first showing the slurry in a relatively uncompressed state (FIG. 4), and then in the process of being compressed (FIG. 5)
Figure 4:
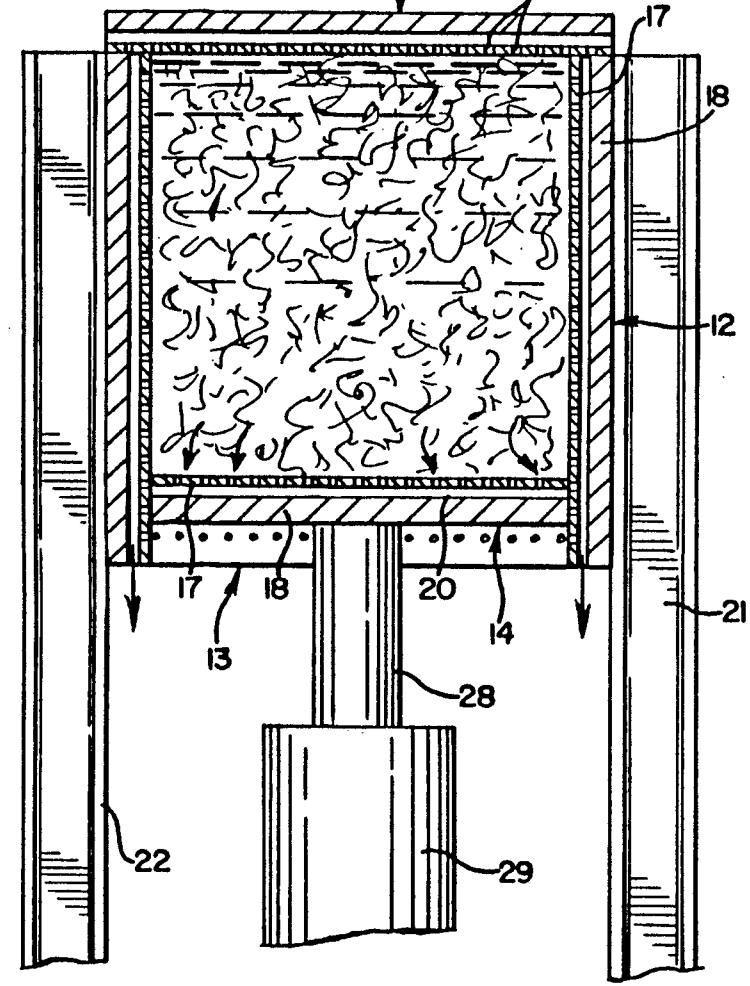
Figure 6:
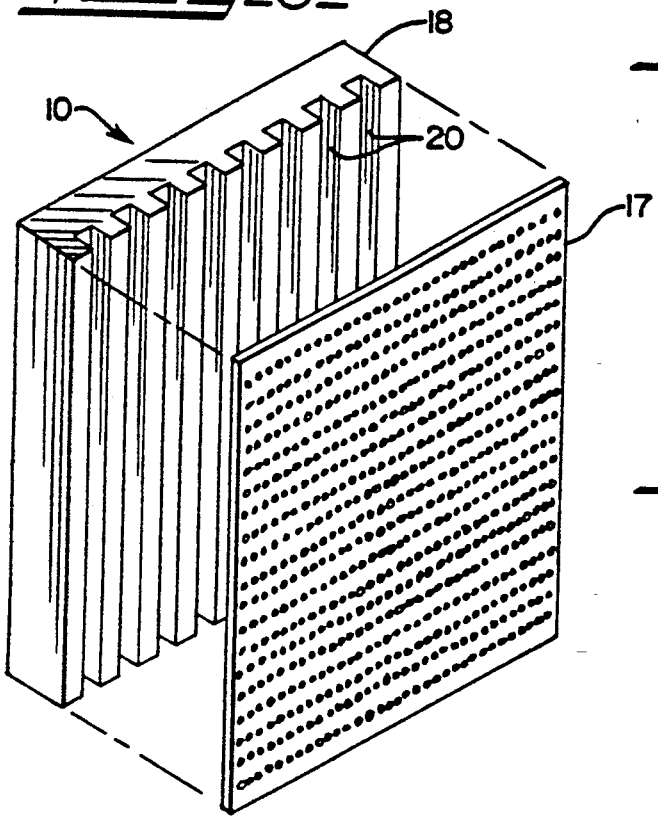
FIG. 6 is a view of a sidewall made of rigid screen and channelled plate.

The slurry to be compressed is poured into the mixing chamber formed by the sidewalls 10–15, as shown in FIG. 4. Top sidewall 15 is then bolted down to close the chamber. As the jack 29 is operated, bottom sidewall 16 moves upwardly, compressing the slurry (FIG. 5). Water and air are thereby squeezed from the slurry and pass through the screens 17 and channelled plates 18 to drain, as indicated by the arrows in FIGS. 4 and 5. The ability of water and air to drain from all sides decreases the amount of time it takes to press the slurry into a block, and also is considered to help produce a block that has a more uniform density. A more uniform density in turn is advantageous, since it helps prevent warping, caused by shrinkage during drying. A vacuum system can be used to assist drainage during compression.

The amount of pressure applied depends on the density of the product desired. More pressure generally yields a product with finer detail which is also stronger. Pressures of about 600 to about 700 lbs./sq.in. are considered most advantageous for finer detail. Jewelry made from pulp pressed at about 150 lbs./sq.in has also been found satisfactory. Pressures from 10 to 2000 lbs./sq.in. are generally considered to be in the optimum range of the invention as presently practiced.

Figure 3:
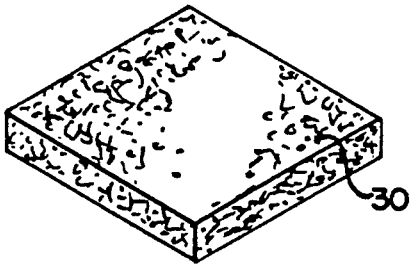
FIG. 3 shows a block of compressed pulp made with the press of FIGS. 1 and 2.

If binders such as plaster and concrete are used, the compressed pulp must be allowed to harden while under pressure. The block product 30 produced from the foregoing process and press (FIG. 3) can otherwise be removed from the molding chamber after compression is complete, and allowed to air dry. Air drying can take about a week, depending on the product's thickness and density.

Figure 11:
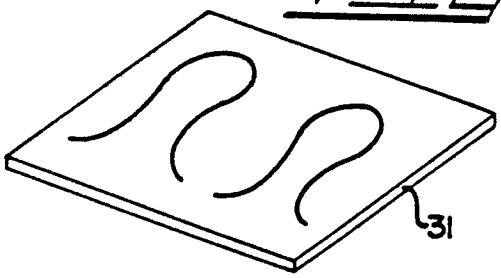
FIG. 11 shows a template used with the press.

FIG. 11 shows a template 31 that can be used during compression to impress an image on the finished block 30. The template 31 is placed in the bottom of the molding chamber prior to pouring in the slurry. Such a template is useful, for example, in making a decorative frame or facade, such as shown in FIG. 10.

Figure 7:
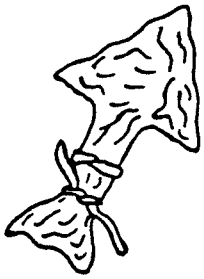
FIGS. 7–10 show some products that can be made in accordance with the present invention.
Figure 8:
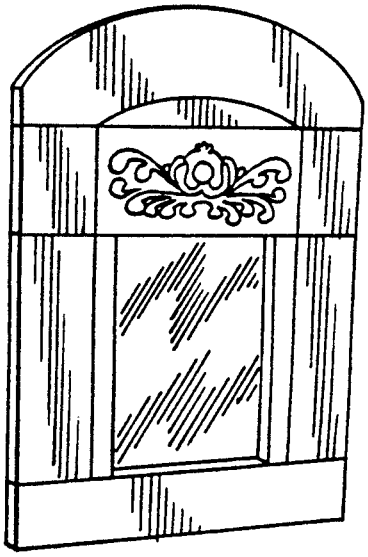
Figure 9:
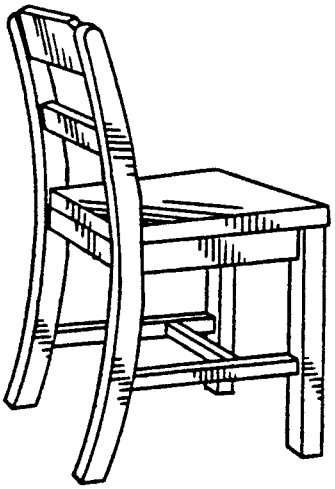
Figure 10:
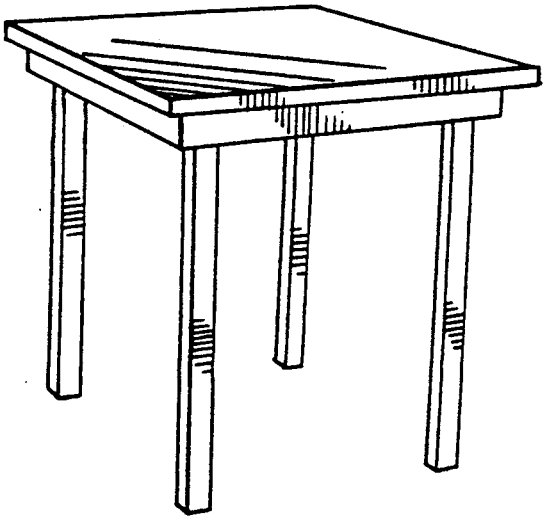

Other products that can be made according to the foregoing method include an arrow-shaped article of jewelry (FIG. 7), and furniture such as a chair (FIG. 9) and table (FIG. 10). The chair and table can be fabricated from stock blocks 30 which are cut and shaped to make legs, seats etc. for the final product desired. Toys can also be machined from a single block, for another example. Insulation, sound-proofing material, bricks, burnable logs, tile and large-scale building materials are some other end products that can be made from the compressed material formed using the foregoing method. Compressed products having layers of differing composition are also contemplated. It has also been found that lightly sanding fine-grained material made in accordance with the invention produces a "fuzzy" texture to the product.

Thus, while the invention has been described with reference to a particular embodiment, those with skill in this art will recognize modifications of structure, arrangement and materials beyond those described herein, but which still fall within the scope of the invention.

What is claimed is:

1. A pulp press comprising:

a molding chamber defined on all sides by sidewalls for receiving an aqueous pulp to be compressed, each of said sidewalls being comprised of a rigid screen through which water can pass, said screen being the innermost portion of each said sidewall, and a rigid impermeable plate outboard from said screen, said rigid impermeable plate having channels formed therein facing said screen through which channels liquid can flow to drain, one of said sidewalls being movable into said molding chamber to serve as a piston, means for fixing all but said moving sidewall together, and means to move said movable sidewall into said chamber to compress pulp therein to a desired pressure and pulp density, whereby water and air are forced out of said pulp through said screens and into said rigid plate channels to drain.

* * * * *